US010573284B2

(12) United States Patent
Konishi

(10) Patent No.: US 10,573,284 B2
(45) Date of Patent: Feb. 25, 2020

(54) ELECTRONIC MUSICAL INSTRUMENT, METHOD, AND NON-TRANSITORY COMPUTER-READABLE STORAGE MEDIUM

(71) Applicant: CASIO COMPUTER CO., LTD., Shibuya-ku, Tokyo (JP)

(72) Inventor: Tomomi Konishi, Fuchu (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/367,800

(22) Filed: Mar. 28, 2019

(65) Prior Publication Data

US 2019/0304417 A1 Oct. 3, 2019

(30) Foreign Application Priority Data

Mar. 30, 2018 (JP) ..... 2018-069628

(51) Int. Cl.
*G10H 1/00* (2006.01)
*G10H 1/36* (2006.01)

(52) U.S. Cl.
CPC ..... *G10H 1/0008* (2013.01); *G10H 2210/076* (2013.01)

(58) Field of Classification Search
CPC ..... G10H 1/0025; G10H 2240/145; G10H 2210/091; G10H 2210/076;
(Continued)

(56) References Cited

U.S. PATENT DOCUMENTS

2014/0020546 A1* 1/2014 Sumi ..... G10H 1/0008 84/609
2016/0093277 A1* 3/2016 Sapp ..... G10H 1/28 84/645

FOREIGN PATENT DOCUMENTS

JP H07036452 A 2/1995
JP H08305354 A 11/1996
(Continued)

*Primary Examiner* — Marlon T Fletcher
(74) *Attorney, Agent, or Firm* — Holtz, Holtz & Volek PC

(57) ABSTRACT

An electronic musical instrument is provided. The electronic musical instrument comprises performance operational elements including a first operational element and a second operational element. In response to a user operation of the first operational element during reproduction of the song data, the instrument receives first performance information including event information indicating an event other than a note event and event timing information indicating a timing of the user operation of the first operational element, and stores the first performance in a first region of the memory. In response to a user operation of the second operational element during reproduction of the song data, the instrument receives second performance information including note event information indicating a note event and note event timing information indicating a timing of the user operation of the second operational element, and changes the note event timing information into information indicating a timing among a plurality of timings determined in accordance with a set phonetic value, and stores the second performance information including the information indicating the timing among the plurality of timings in a second region of the memory. The first performance information and the second performance information are merged when no song data is reproduced after completion of the reproduction of the song data.

8 Claims, 10 Drawing Sheets

(58) Field of Classification Search
CPC ..... G10H 2240/165; G10H 2240/071; G10H 1/366; G10H 2240/131; G10H 1/365; G10H 2210/111; G10H 1/36; G10H 2240/031; G10H 1/0033; G10H 7/00; G10H 2210/101; G10H 7/008; G10H 1/18; G10H 1/20; G10H 2240/325; G10H 1/0575
See application file for complete search history.

(56) References Cited

FOREIGN PATENT DOCUMENTS

| | | | |
|---|---|---|---|
| JP | 2003228368 | A | 8/2003 |
| JP | 2004085610 | A | 3/2004 |
| JP | 2010231052 | A | 10/2010 |

* cited by examiner

ELECTRONIC MUSICAL INSTRUMENT, METHOD, AND NON-TRANSITORY COMPUTER-READABLE STORAGE MEDIUM

CROSS-REFERENCE TO RELATED APPLICATION

This application claims the benefit of Japanese Patent Application No. 2018-069628, filed on Mar. 30, 2018, the entire disclosure of which is incorporated by reference herein.

FIELD

The present disclosure relates to an electronic musical instrument, a method, and a non-transitory computer-readable storage medium.

BACKGROUND

In the related art, there is technology that executes a processing called quantization that, in performance information stored in advance, performs adjustment of sound generation timing of phonetic values included in the performance information (for example, see Unexamined Japanese Patent Application kokai Publication No. H7-36452). Also in the related art, there is technology that matches a sound generation timing of multiple electronic musical instruments by receiving the quantization timing from the electronic musical instruments and correcting the quantization timing during a performance by the multiple electronic musical instruments (for example, see Unexamined Japanese Patent Application kokai Publication No. 2010-231052).

In the prior art, when a performed song is recorded while being superimposed on a previously stored song, the previously stored song and the performed song are collectively quantized. However, in the case of recording and superimposition, selective quantization of the performed song, such as performing quantization only of the performed song without performing quantization of the previously stored song, or not quantizing the performed song, is requested.

According to one embodiment of the present disclosure, performance information generated by performance can be stored while being superimposed on previously stored song data appropriately.

SUMMARY

According to one aspect of the present disclosure, an electronic musical instrument comprises:

performance operational elements including a first operational element and a second operational element;

a memory; and at least one processor configured to reproduce song data, in response to a user operation of the first operational element during reproduction of the song data, (i) receive first performance information including event information indicating an event other than a note event and event timing information indicating a timing of the user operation of the first operational element, and (ii) store, in a first region of the memory, the first performance information, in response to a user operation of the second operational element during reproduction of the song data, (i) receive second performance information including note event information indicating a note event and note event timing information indicating a timing of the user operation of the second operational element, (ii) change the note event timing information into information indicating a timing among a plurality of timings determined in accordance with a set phonetic value, and (iii) store, in a second region of the memory, the second performance information including the information indicating the timing among the plurality of timings, and start merger of the song data, the first performance information stored in the first region, and the second performance information including the information stored in the second region when no song data is reproduced after completion of the reproduction of the song data.

According to the present disclosure, the performance information generated by the performance can be stored while being superimposed on the previously stored song data appropriately.

BRIEF DESCRIPTION OF THE DRAWINGS

A more complete understanding of this application can be obtained when the following detailed description is considered in conjunction with the following drawings, in which.

DETAILED DESCRIPTION

An embodiment of the present disclosure is described below with reference to drawings.

Figure 1:
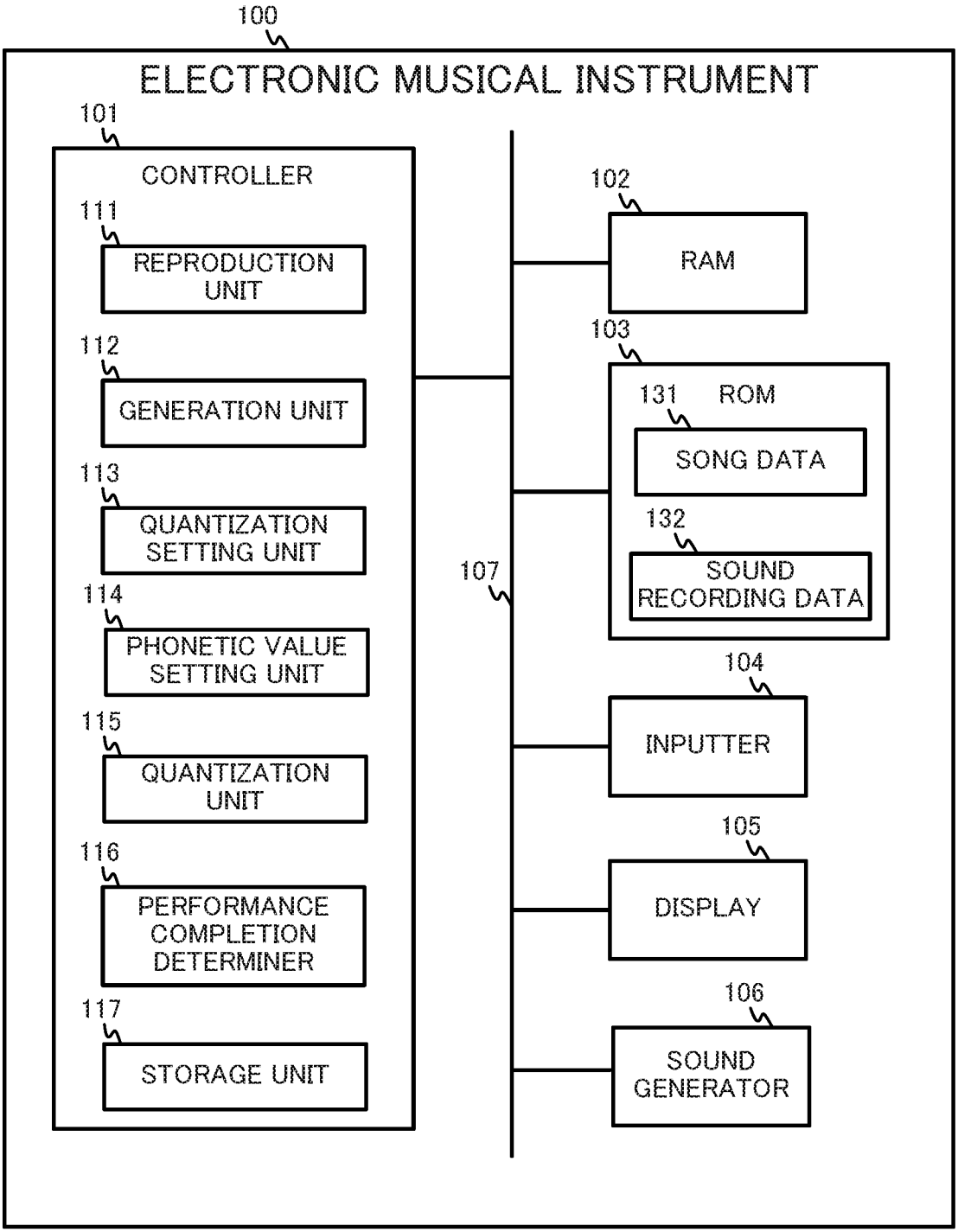
FIG. 1 is a schematic block diagram illustrating an example configuration of an electronic musical instrument according to an embodiment.

FIG. 1 is a schematic block diagram illustrating an example configuration of an electronic musical instrument 100 according to an embodiment of the present disclosure. Firstly, a hardware configuration of the electronic musical instrument 100 according to the present embodiment is described. As illustrated in FIG. 1, the electronic musical instrument 100 includes a controller 101, a random access memory (RAM) 102, a read only memory (ROM) 103, an inputter 104, a display 105, and a sound generator 106, and each component is interconnected by a bus 107.

The controller 101 is an example of a performance information editing device according to the present disclosure and includes a central processing unit (CPU). The controller 101 performs overall control of the electronic musical instrument 100 by reading programs and data stored in the ROM 103 and using the RAM 102 as a working area.

The RAM 102 is used for temporary storage of the data and programs, and holds information such as programs and data read from the ROM 103, data required for communication, or the like. In the present embodiment, the RAM 102 is an example of a first storage unit; includes a first storage region (first region) 121, a second storage region (second region) 122, and a third storage region (third region) 123 as described below; and holds data generated by the controller 101.

The ROM 103 is a non-volatile semiconductor memory such as a flash memory, an erasable programmable ROM (EPROM), or an electrically erasable programmable ROM (EEPROM), and functions as a so-called secondary storage device or auxiliary storage device. The ROM 103 stores programs and data used by the controller 101 for performing various types of processing, and also stores data generated or acquired by the controller performing various types of processing. In the present embodiment, the ROM 103 is an example of a second storage unit, and stores song data 131 and sound recording data 132. The song data 131 and the sound recording data 132 are data stored in musical instrument digital interface (MIDI) format, for example.

The inputter 104 includes an input device such as a keyboard, mouse, touchpad, buttons, or the like. The inputter 104 receives an input operation from a user, and outputs to the controller 101 an input signal indicating content of the operation. Further, the inputter 104 may be a keyboard that has white keys and black keys that are examples of performance operational elements. In this case, the inputter 104 receives an instruction to generate a musical sound in accordance with a key-pressing operation to a key by the user.

That is to say, the inputter 104 has performance operational elements. As described below, performance information indicating an event other than a note event is generated in response to operation of a first operational element among the performance operational elements, and performance information indicating a note event is generated in response to operation of a second operational element among the performance operational elements.

The display 105 is a display device such as a liquid crystal display (LCD) panel, an organic electro-luminescence (EL) device, a light emitting diode (LED) device, or the like. Moreover, the display 105 displays an image in accordance with a control signal from the controller 101. Note that the inputter 104 and the display 105 may be arranged to overlap each other in a touch panel or a touch screen.

The sound generator 106 includes a sound output apparatus such as a speaker and outputs an audio signal outputted from the controller 101.

A functional configuration of the controller 101 of the electronic musical instrument 100 according to the present embodiment is described next. As illustrated in FIG. 1, the controller 101 reads and executes programs and data stored in the ROM 103 to function as a reproduction unit 111, a generation unit 112, a quantization setting unit 113, a phonetic value setting unit 114, a quantization unit 115, a performance completion determiner 116, and a storage unit 117.

The controller 101 as the reproduction unit 111 executes reproduction processing that reproduces the song data 131 stored in advance. For example, the controller 101 reads the song data 131 stored in the ROM 103 out to a third storage region 123 of the RAM 102, and executes processing of events corresponding to a tick count indicated by a tick counter while updating in single tick increments the tick counter indicating the tick count up to the present time after a start of the song. A tick is a unit of subdivision that is finer than a measure or beat, and when the resolution is 96 bits per quarter note (bpqn), for example, a tick indicates a length of one 96th of a quarter note.

The controller 101 as the generation unit 112 executes generation processing that generates, in response to an operation of the performance operational element during reproduction of the song data by reproduction processing, performance information that includes timing information of the operation. In the present embodiment, upon inputting of some event by the user operating the inputter 104 as performance operational elements, the controller 101 generates performance information that includes the inputted event, and as timing information of the operation, the tick count indicated by the tick counter at the time of event input. The "events" specify a type of event, such as notes, pitch bend operations, pedal operations, and timbre switching, and various values according to the type of event. For example, a note event (generated in response to operation of the first operational element) specifies a note-on indicating pressing of a key or a note-off indicating release of a key, and pitch (note number) and strength of sound (velocity) corresponding to operation of the performance operational elements. The timing information is indicated in a value of the tick counter in tick units, for example.

The controller 101 as the quantization setting unit 113 executes quantization setting processing that sets whether the quantization processing executed by the quantization unit 115 is effective or non-effective. In the present embodiment, the controller 101 receives from the user via the inputter 104 an operation indicating whether the quantization processing is effective or non-effective, and in response to the received operation, sets whether the quantization processing is either effective or non-effective.

The controller 101 as the phonetic value setting unit 114 executes phonetic value setting processing that sets a phonetic value indicating a time value of sound. In the present embodiment, when the note event is a note-on, the controller 101 acquires the tick count (quantize_tick) of the phonetic value to be quantized. For example, when the resolution is 96 bpqn, the tick count of the phonetic value is 48 if the phonetic value is an eighth note.

The controller 101 as the quantization unit 115 changes the timing information included in the performance information generated by the generation processing into determined timing information. In the present embodiment, the controller 101 changes the timing information included in the generated performance information to match one of the timings among multiple timings corresponding to the set phonetic value.

An example of a method for changing the timing information is described below with reference to FIGS. 2A and 2B. In the below-described example, in the case of the inputted event being a note event and quantization processing being set to be effective, the controller 101 changes the tick count indicated by the timing information included in the performance information by a method shown in either FIG. 2A or 2B.

Firstly, the controller 101 compares a tick count (quantize_tick) of the phonetic value and a tick count (tick_counter) indicated by the tick counter, and uses the below-listed Formula 1 to acquire a tick count (gap_tick), where gap_tick indicates what number of ticks the last tick of tick_counter counted from the start of the performance corresponds to among the ticks of the tick count counted from a start timing of a timing period between consecutive timings corresponding to a phonetic value.

$$gap_tick = tick_counter \% quantize_tick \quad \text{(Formula 1)}$$

Formula 1 indicates that the remainder obtained by division of tick_counter by quantize_tick is gap_tick.

For example, when the tick count indicated presently by the tick counter is 500 and the phonetic value of the tick count is 48, then gap_tick is calculated in the below indicated manner.

$$gap_tick = tick_counter \% quantize_tick = 500\% 48 = 20$$

Figure 2A:
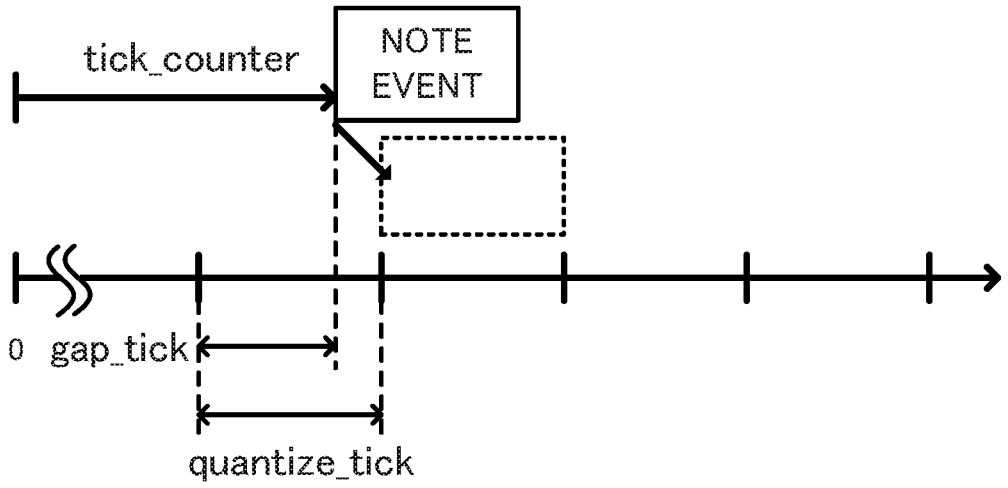
FIG. 2A is a drawing for description of an example of a method for changing timing information.

Then when the value of gap_tick calculated by Formula 1 is greater than or equal to half of the value of quantize_tick, as illustrated in FIG. 2A, the controller 101 calculates how many ticks there are until the end timing of the timing period corresponding to the phonetic value, and uses the below-listed Formula 2 to acquire a value(tick_counter_new) of the tick counter that is a value of the tick counter after quantization by shifting back the value of tick_counter in accordance with the calculated tick count.

$$tick_counter_new = tick_counter + (quantize_tick - gap_tick) \quad \text{(Formula 2)}$$

Figure 2B:
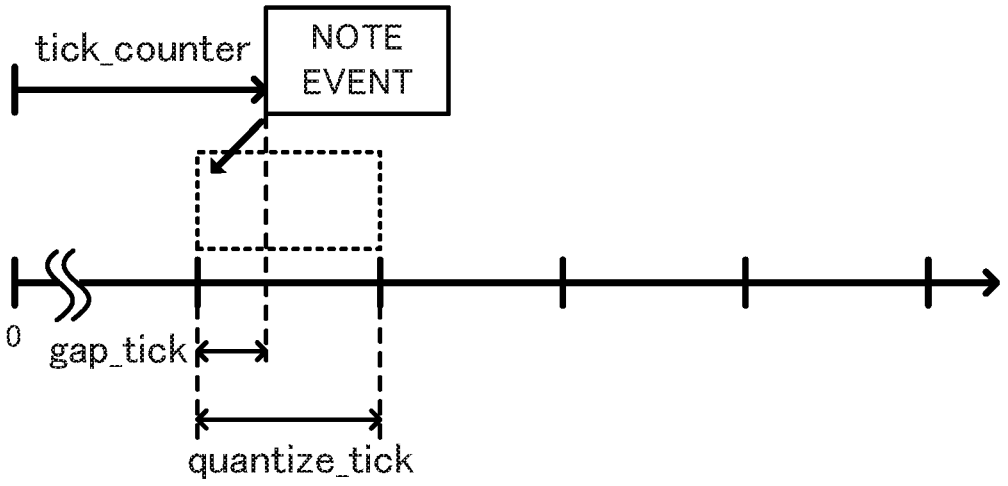
FIG. 2B is a drawing for description of the example of the method for changing timing information.

Further, when gap_tick calculated by the Formula 1 is less than half the value of quantize_tick, as illustrated in FIG. 2B, the controller 101 uses the below-listed Formula 3 to acquire a value (new_tick_counter) of the tick counter that is a value of the tick counter after quantization by shifting forward from the value of the tick counter by just the value of gap_tick.

$$tick_counter_new = tick_counter - gap_tick \quad \text{(Formula 3)}$$

Moreover, in the case in which the note event is a note-off, the controller 101 moves the timing of the note-off so as to maintain a differential time period from the timing of the actual note-on until the present time. That is, in the case in which the note-on is moved forward by the quantization processing, the controller 101 causes the note-off also to be moved forward by the same time period. Moreover, in the case in which the note-on is moved backward by the quantization processing, the controller 101 causes the note-off also to be moved backward by the same time period.

Note that, quantization processing in the case in which the note event is expressed as the note-on or the note-off is described above. In the case in which the note event is expresses in gate time format, in the note-off time quantization processing, the controller 101 calculates the gate time by subtracting the tick count of the note-on prior to execution of quantization from the value of the tick count of the note-off. This is followed by searching for a note-on event for which storage is completed, and overwriting the calculated gate time.

Then the controller 101 stores in the second storage region 122 of the RAM 102 the value of the tick counter after quantization as changed timing information, while being included, together with the event, in the performance information.

In the case in which an operation is detected that causes stoppage of sound recording of the performance in response to an operation of the performance operation element, and/or in the case of a determination that the sound recording of the performance cannot be continued, the controller 101 as the performance completion determiner 116 executes performance completion determination processing that determines whether the performance is completed. In the present embodiment, the controller 101 determines that the performance is completed, for example, upon receiving a sound recording completion operation for the performance from the user via the inputter 104, and upon determination that memory for sound recording of the performance is insufficient and that sound recording of the performance cannot be continued.

The controller 101 as the storage unit 117 in response to the completion of the performance stores, together with song data, the performance information including the timing information determined in accordance with the set phonetic values. In the present embodiment, upon determination that the performance is completed, the controller 101 stores the performance information together with the song data in response to the completion of the performance.

Specifically, in response to the completion of the performance, the controller 101 stores, together with the song data, either the performance information having quantization processing executed thereon or the performance information having quantization processing not executed thereon, in accordance with whether the quantization processing is set to be effective or non-effective. For example, when the quantization processing is set to be effective, upon determination that the performance is completed, the controller 101 stores, together with the song data, the performance information having the quantization processing executed thereon in response to the completion of the performance. Moreover, when the quantization processing is set to be non-effective, upon determination that the performance is completed, the controller 101 stores, together with the song data, the performance information not having the quantization processing executed thereon in response to the completion of the performance.

More specifically, upon determination that the performance is completed, the controller 101 stores in the first storage region 121 un-reproduced remaining song data 131 stored in the third storage region 123 of the RAM 102. Then the controller 101 stores an end of track (EOT) event in the first storage region 121, and if the quantization processing is set to be effective, merges the performance information stored in the second storage region 122 with the performance information stored in the first storage region 121, and stores the merged data in the first storage region 121. Then the controller 101 stores in the ROM 103 the data stored in the first storage region 121.

Figure 3A:
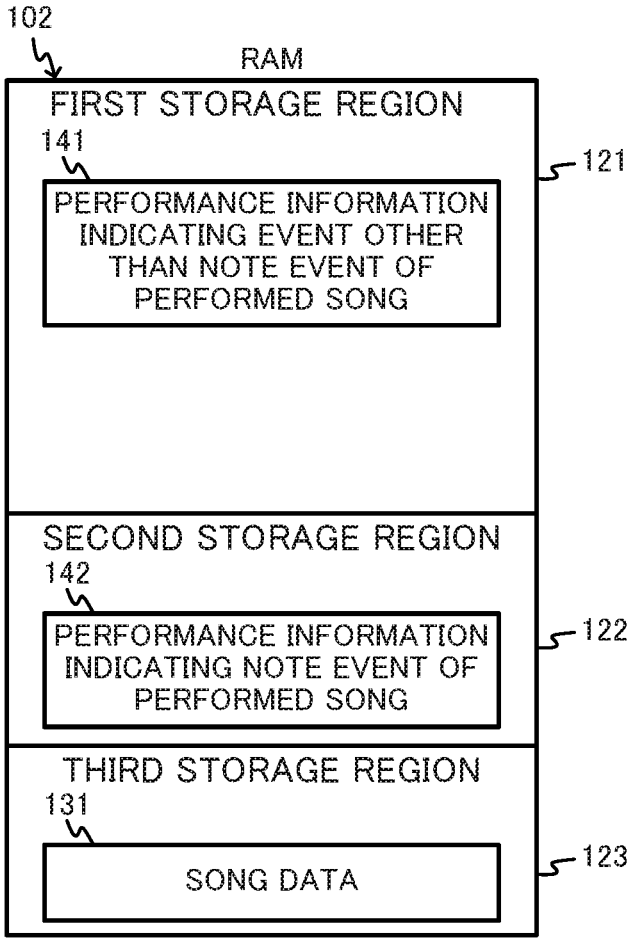
FIG. 3A is a drawing for description of storage regions provided in RAM and data stored in each of the storage regions.
Figure 3B:
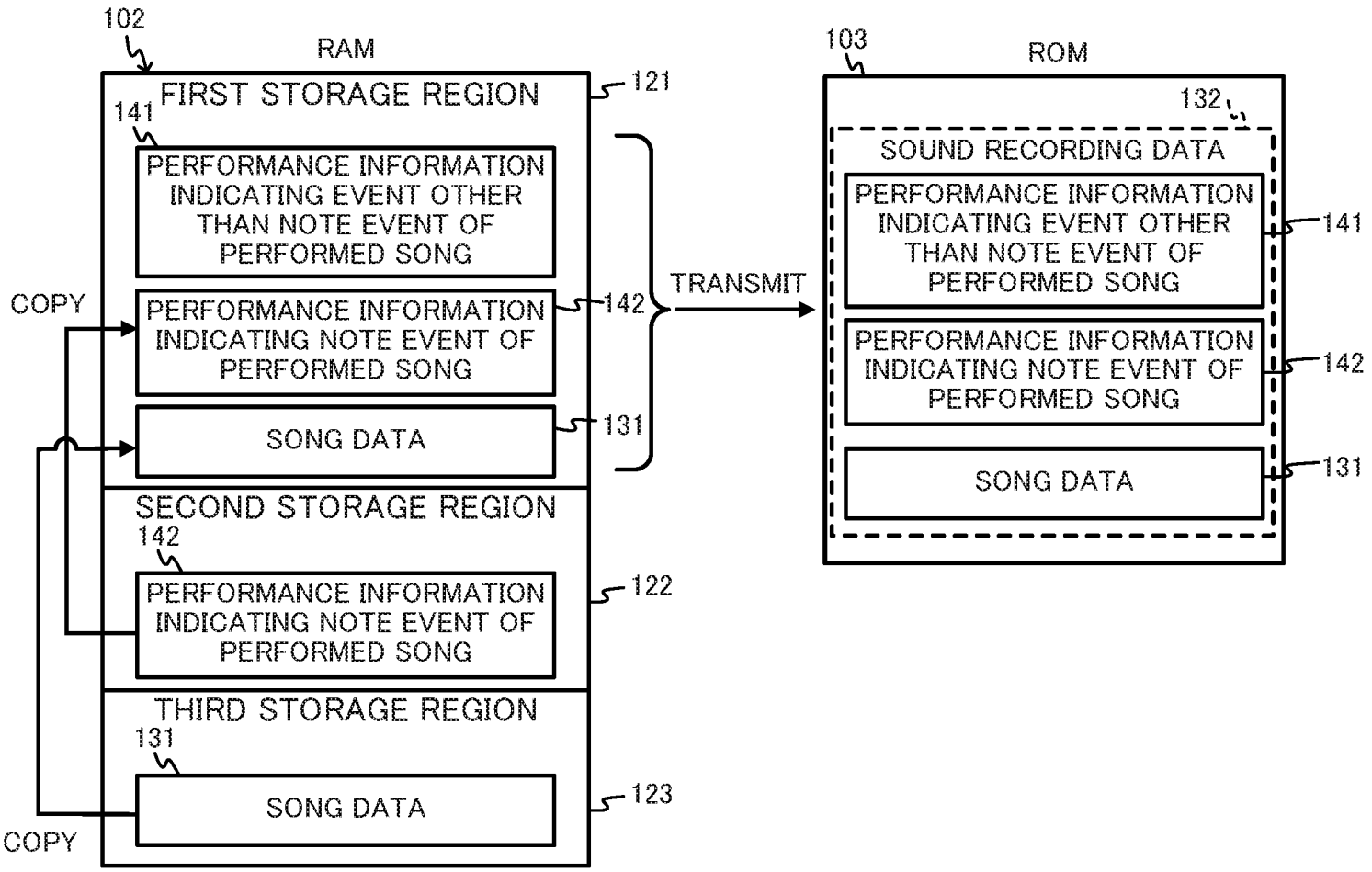
FIG. 3B is a drawing for description of the storage regions provided in RAM and the data stored in each of the storage regions.

Here, the storage regions arranged in the RAM 102 and the data stored in each of the storage regions are described with reference to FIGS. 3A and 3B. During execution of sound recording processing for which the quantization processing is set to be effective, as illustrated in FIG. 3A, in the first storage region 121 performance information 141 is stored that indicates an event other than a note event of the performed song (generated in response to operation of the second operational element), such as pedal operation, pitch bending, or timbre changing. Thus, the first storage region 121 stores performance information for which timing information is not changed by the quantization processing. Further, performance information 142 indicating the note events of the performed song is stored in the second storage region 122. Thus the second storage region 122 stores performance information for which the timing information is changed by the quantization processing. Moreover, the third storage region 123 stores the song data 131 of the reproduced song. During reproduction of the song data 131 stored in the third storage region 123, the controller 101 copies the reproduced song data 131 to the first storage region 121. Then at the time of completion of the sound recording processing, as illustrated in FIG. 3B, the performance information 142 stored in the second storage region 122 is copied to the first storage region 121, and after merging of the performance information 141 and 142 with the song data 131, the merged information is transmitted to the ROM 103 and is stored in the ROM 103 as the sound recording data 132.

Note that, during execution of sound recording for which the quantization processing is set to be non-effective, the controller 101 stores in the first storage region 121 the performance information 142 indicating the note events of the performed song.

The reason for storing only the events having quantization performed thereon in a separate storage region as described above is described below. Since events other than performed note events and events of re-recorded reproduced song data 131 are already stored in the first storage region 121, if a note event is stored at a timing prior to the present location by quantization, storing in the same first storage region 121 requires searching of a storage position starting from the start position and insertion. In this case, the larger data size from the start position to the storage position is, the longer processing time is, and the ability to generate sound during sound recording in real time may be compromised when delay in sound generating or the like occurs. In order to avoid this difficulty, the second storage region 122 which is separate from the first storage region 121 is secured for temporary storage during sound recording, and the quantized events are stored in the second storage region 122, thereby enabling a lessening of the load of processing during sound recording.

That is to say, the controller 101 reproduces the song data;

in response to the user operation of the first operation element during reproduction of the song data, stores, in the first region of the memory, the performance information including (i) the information indicating the event other than the note event and (ii) the timing information indicating the timing of the user operation of the first operational element;

in response to the user operation of the second operational element during reproduction of the song data, (i) changes the timing information indicating the timing of the user operation of the second operational element into timing information indicating a timing of a plurality of timings determined in accordance with the set phonetic values, and (ii) stores, in the second region of the memory, performance information including the changed timing information and the information indicating the note event; and without starting the merger of the song data, the performance information stored in the first region, and the performance information stored in the second region during reproduction of the song data, starts the merger after completion of reproduction of the song data automatically without user intervention.

Due to such operation, according to the present embodiment, the merger of the song data, the performance information stored in the first region, and the performance information stored in the second region starts after the reproduction of the song data, and the merger of the song data, the performance information stored in the first region, and the performance information stored in the second region does not start during the reproduction of the song data, and thus the increase of the load of processing during the performance is suppressed. Such operation enables a decrease in the risk of occurrence of harmful effects such as delayed reproduction of the song data.

Figure 4:
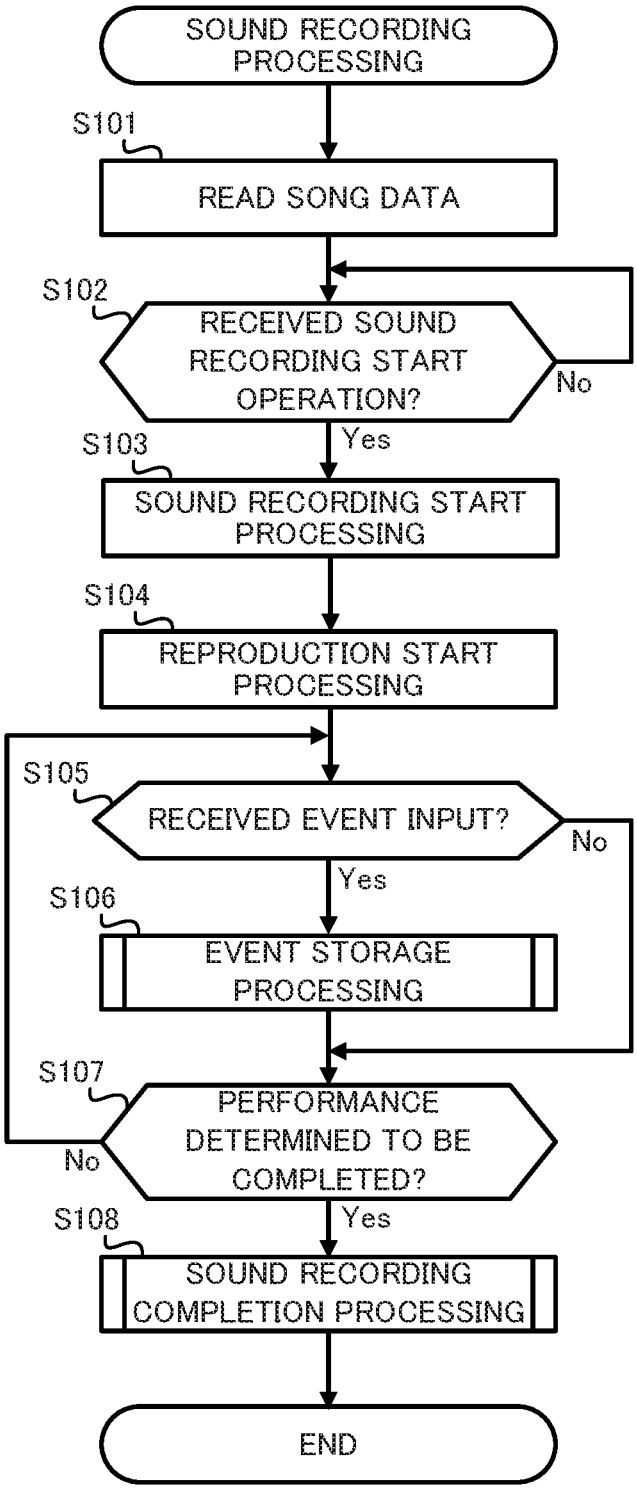
FIG. 4 is a flowchart of sound recording processing executed by a controller of the electronic musical instrument according to the embodiment.

FIG. 4 is a flowchart of the sound recording processing executed by the controller 101 of the electronic musical instrument 100 in the present embodiment. The controller 101 starts the sound recording processing upon the reception via the inputter 104 of the operational input indicating the start of the present processing, for example.

The controller 101 reads from the ROM 103 the song data 131 and writes the read song data 131 to the third storage region 123 of the RAM 102 (step S101).

Then, the controller 101 determines whether the sound recording start operation is received via the inputter 104 (step S102). The controller 101 waits until receiving the sound recording start operation (no in step S102).

Upon receiving the sound recording start operation (yes in step S102), the controller 101 executes the sound recording start processing (step S103). Moreover, the controller 101 executes the reproduction start processing of the read song data 131 written to the third storage region 123 (step S104).

Then the controller 101 determines whether an event input is received via the inputter 104 (step S105). When the event input is not received (no in step S105), the controller 101 proceeds to the processing of step S107.

Upon reception of the event input (yes in step S105), the controller 101 executes the event storage processing described below (step S106).

Then, the controller 101 determines whether the performance is completed (step S107). Upon determination that the performance is not completed (no in step S107), the controller 101 returns to the processing of step S105.

Upon determination that the performance is completed (yes in step S107), the controller 101 executes the sound recording completion processing described below (step S108). Then, the controller 101 ends the sound recording processing.

Figure 5:
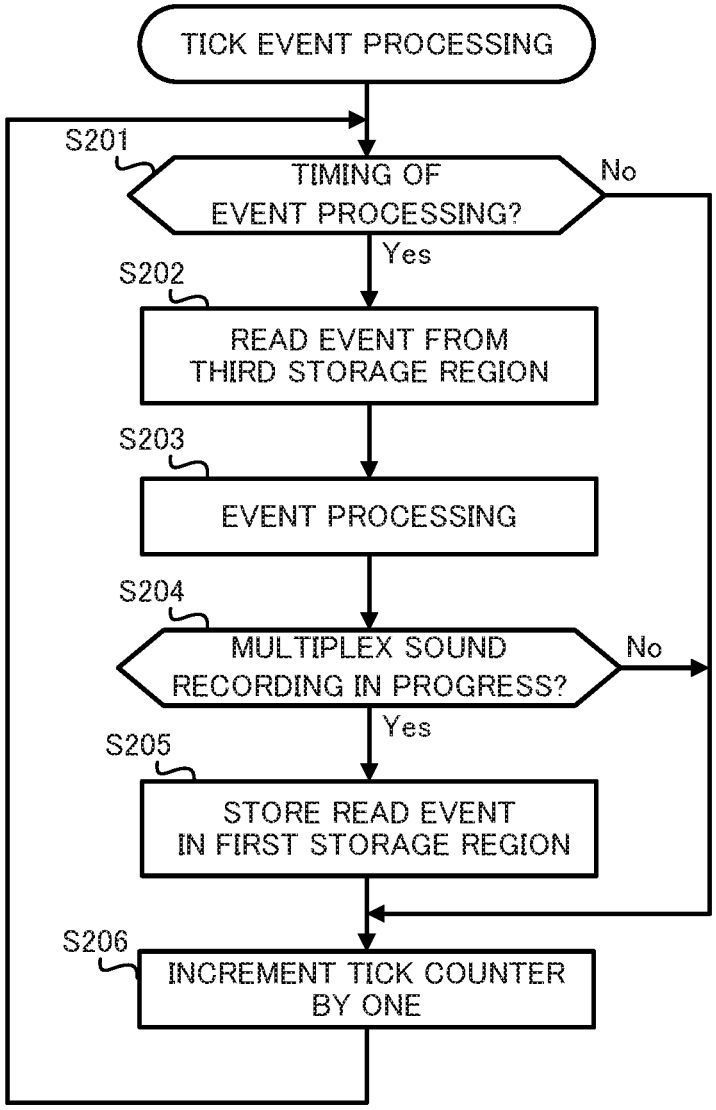
FIG. 5 is a flowchart of tick event processing executed by the controller of the electronic musical instrument according to the embodiment.

Tick event processing executed upon execution of the reproduction start processing of step S104 of FIG. 4 by the controller 101 of the electronic musical instrument 100 in the present embodiment is described next. FIG. 5 is a flowchart of tick event processing executed by the controller 101 of the electronic musical instrument 100 in the present embodiment. Note that, the tick counter is set to zero at the start time of reproduction of the song data 131.

Firstly, the controller 101 determines whether the value of the present tick counter is the timing of the event processing (step S201). When the value of the present tick counter is not the timing of the event processing (no in step S201), the controller 101 proceeds to the processing of step S206.

When the value of the present tick counter is the timing of the event processing (yes in step S201), the controller 101 reads, from the third storage region 123, the event to be processed (step S202), and processes the read event (step S203).

Then, the controller 101 determines whether multiplex sound recording is presently in progress (step S204). Upon determination that multiplex sound recording is not in progress (no in step S204), the controller 101 proceeds to the processing of step S206.

When multiplex sound recording is in progress (yes in step S204), the controller 101 stores in the first storage region 121 the event read in step S202 (step S205).

Then, the controller 101 increments the tick counter by 1 (step S206), returns to the processing of step S201, and repeats the execution of the processing of steps S201 to S206 until completion of the reproduction of the song data 131.

Figure 6:
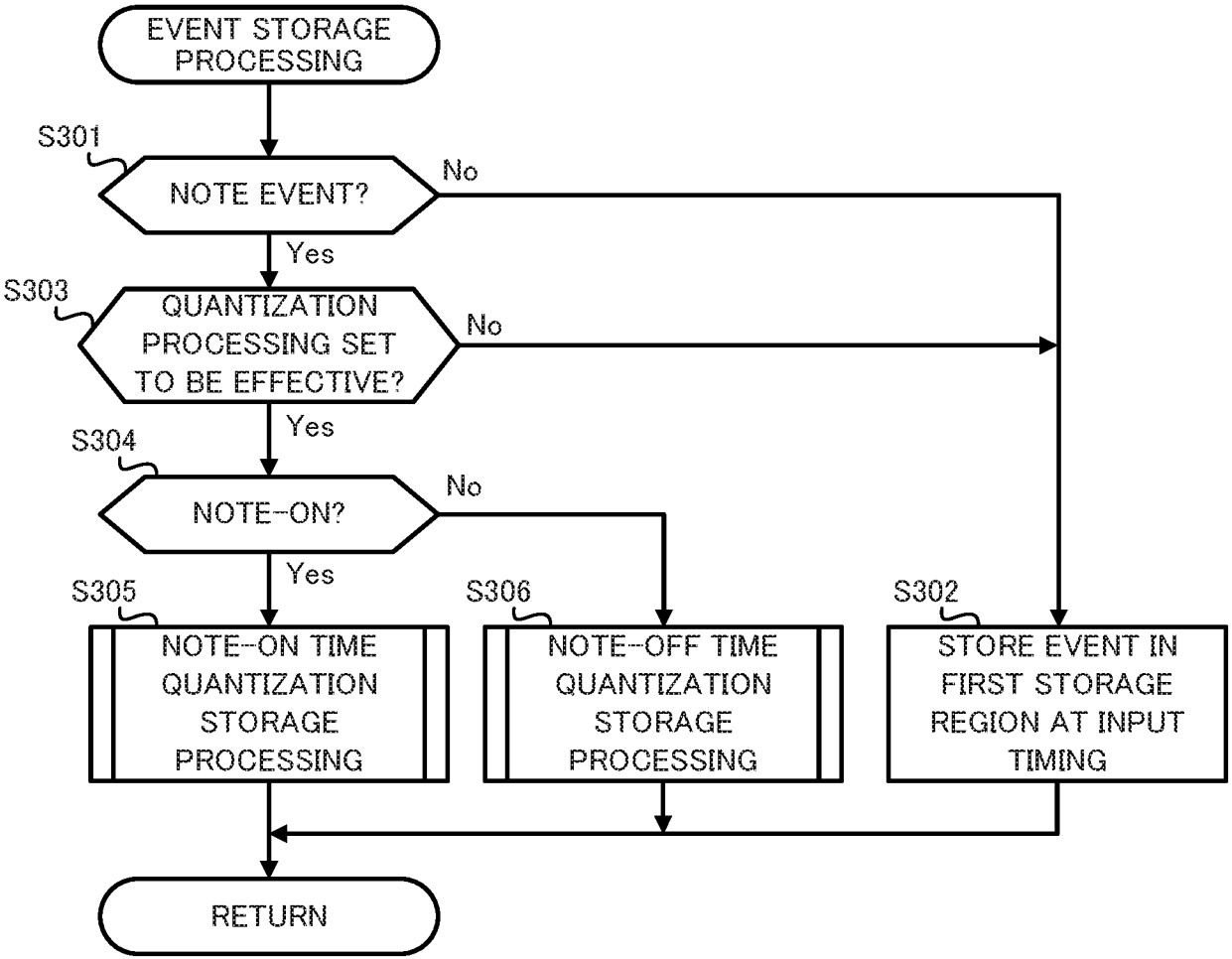
FIG. 6 is a flowchart of event storage processing executed by the controller of the electronic musical instrument according to the embodiment.

Next, event storage processing executed in step S106 of FIG. 4 by the controller 101 of the electronic musical instrument 100 in the present embodiment is described. FIG. 6 is a flowchart of the event storage processing executed by the controller 101 of the electronic musical instrument 100 in the present embodiment.

Firstly, the controller 101 determines whether the event input received in step S105 of FIG. 4 is a note event (step S301).

Upon determination that the received event input is not a note event (no in step S301), the controller 101 stores the received event in the first storage region 121 by the input timing (step S302).

When the received event input is the note event (yes in step S301), the controller 101 determines whether quantization is set to be effective (step S303). When the quantization is not set to be effective (no in step S303), the controller 101 stores in the first storage region 121 the received event by the input timing (step S302).

When quantization is set to be effective (yes in step S303), the controller 101 determines whether the received note event is the note-on (step S304). When the received note event is the note-on (yes in step S304), the controller 101 executes the note-on time quantization storage processing described below (step S305). Moreover, when the received note event is not the note-one (no in step S304), that is, when the received note event is the note-off, the controller 101 executes the note-off time quantization storage processing described below (step S306).

Figure 7:
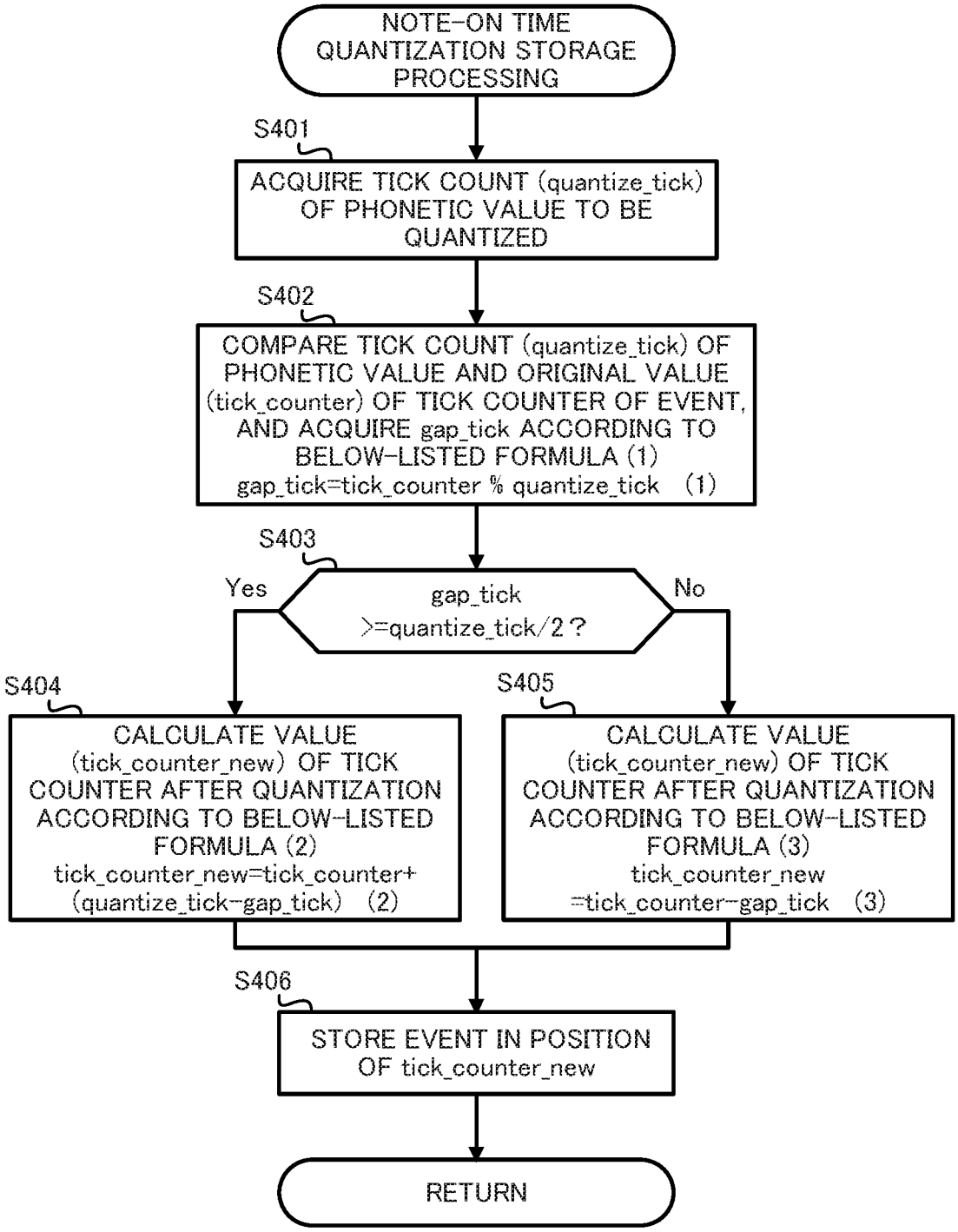
FIG. 7 is a flowchart of note-on time quantization storage processing executed by the controller of the electronic musical instrument according to the embodiment.

The note-on time quantization storage processing executed in step S305 of FIG. 6 by the controller 101 of the electronic musical instrument 100 in the present embodiment is described next. FIG. 7 is a flowchart of the note-on time quantization storage processing executed by the controller 101 of the electronic musical instrument 100 in the present embodiment.

Firstly, the controller 101 acquires the tick count (quantize_tick) of the phonetic value of the note event to be quantized (step S401).

Then, the controller 101 compares the original value (tick_counter) of the tick counter of the note event with the tick count of the phonetic value acquired in step S401, and acquires gap_tick by use of Formula 1 (step S402).

The controller 101 next determines whether the tick count (gap_tick) acquired in step S402 is greater than or equal to half of the tick count (quantize_tick) of the phonetic value (step S403).

When the tick count (gap_tick) acquired in step S402 is greater than or equal to half of the tick count (quantize_tick) of the phonetic value (yes in step S403), the controller 101 calculates by Formula 2 a value (tick_counter_new) of the tick counter after quantization (step S404).

Moreover, when the tick count (gap_tick) acquired in step S402 is less than half of the tick count (quantize_tick) of the phonetic value (no in step S403), the controller 101 calculates by Formula 3 the value (tick_counter_new) of the tick counter after quantization (step S405).

Then, the controller 101 stores the event in the second storage region 122 in a position of the value (tick_counter_new) of the tick counter after quantization (step S406). Then the controller 101 returns to the processing of step S107 of FIG. 4.

Figure 8:
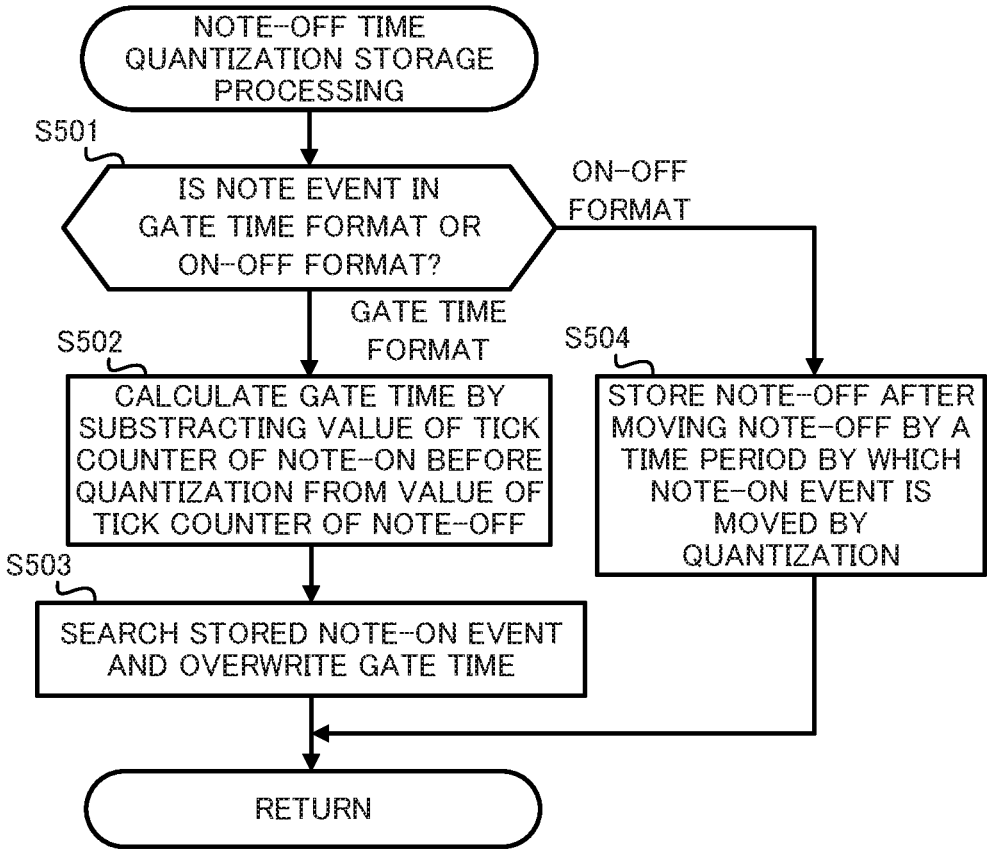
FIG. 8 is a flowchart of note-off time quantization storage processing executed by the controller of the electronic musical instrument according to the embodiment.

The note-off time quantization processing executed in step S306 of FIG. 6 by the controller 101 of the electronic musical instrument 100 in the present embodiment is described next. FIG. 8 is a flowchart of the note-off time quantization storage processing executed by the controller 101 of the electronic musical instrument 100 in the present embodiment.

Firstly, the controller 101 determines whether the note event is expressed in gate time format or in on-off format (step S501).

When the note event is expressed in gate time format ("gate time format" in step S501), the controller 101 calculates the gate time by subtracting the value of the tick counter of the note-on prior to quantization from the value of the tick counter of the note-off (step S502).

Then, the controller 101 searches the second storage region 122 for a note-on event for which storage is completed, and overwrites the gate time calculated in step S502 (step S503). Then, the controller 101 returns to the processing of step S107 of FIG. 4.

Moreover, when the note event is expressed in on-off format ("on-off format" in step S501), the controller 101 causes the note-off to be moved by the time period by which the note-on event is moved by quantization and stores the moved note-off in the second storage region 122 (step S504). Then, the controller 101 returns to the processing of step S107 of FIG. 4.

Figure 9:
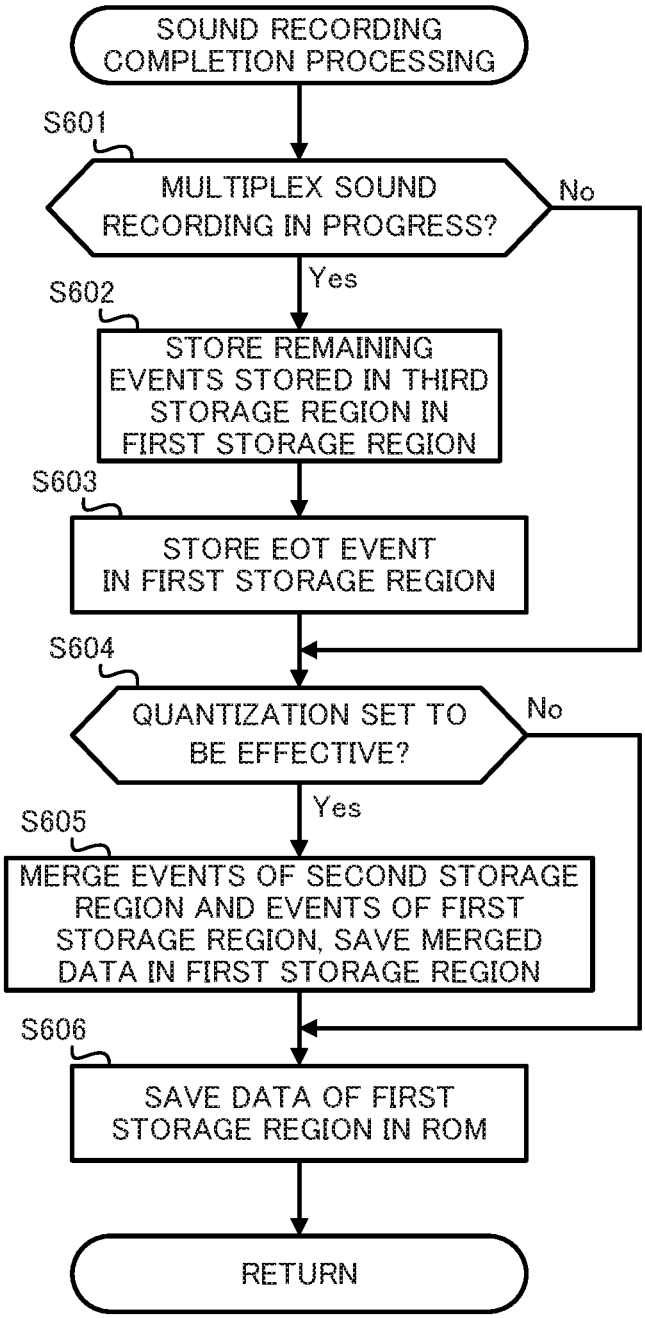
FIG. 9 is a flowchart of sound recording completion processing executed by the controller of the electronic musical instrument according to the embodiment.

The sound recording completion processing executed in step S108 of FIG. 4 by the controller 101 of the electronic musical instrument 100 in the present embodiment is described next. FIG. 9 is a flowchart of the sound recording completion processing executed by the controller 101 of the electronic musical instrument 100 in the present embodiment.

Firstly, the controller 101 determines whether multiplex sound recording is presently in progress (step S601). When multiplex sound recording is not presently in progress (no in step S601), the controller 101 proceeds to the processing of step S604.

When multiplex sound recording is presently in progress (yes in step S601), the controller 101 stores in the first storage region 121 the remainder of the events stored in the third storage region 123 (step S602). Then, the controller 101 stores the EOT event in the first storage region 121 (step S603).

Then, the controller 101 determines whether the quantization is set to be effective (step S604). When the quantization is not set to be effective (no in step S604), the controller 101 stores the data of the first storage region 121 in the ROM 103 (step S606), and ends the sound recording processing.

When quantization is set to be effective (yes in step S604), the controller 101 merges the event stored in the second storage region 122 and the event stored in the first storage region 121, and stores the merged data in the first storage region 121 (step S605). Then, the controller 101 stores in the ROM 103 the data stored in the first storage region 121 (step S606). Then, the controller 101 ends the sound recording processing.

As described above, the controller 101 of the electronic musical instrument 100 according to the present embodiment executes quantization processing that, during reproduction of the stored song data 131, changes the timing information included in the performance information generated by the performance into prescribed timing information, and stores, together with the song data 131, the performance information that includes the timing information having quantization processing executed thereon. Thus, even in the case of multiplex sound recording on a single track, the performance information generated by the performance can be recorded while being superimposed on the stored song data appropriately.

Moreover, the controller 101 of the electronic musical instrument 100 according to the present embodiment stores the reproduced song data 131 in the first storage region 121 of the RAM 102, and stores the performance information including the prescribed timing information changed by the quantization processing in the second storage region 122 of the RAM 102. In this manner, the controller 101 stores the events having quantization executed thereon in the second storage region 122 that is different from the first storage region 121 storing the song data 131, thereby enabling a lessening of the load of processing during sound recording.

Moreover, the controller 101 of the electronic musical instrument 100 according to the present embodiment sets the quantization processing to be either effective or non-effective. Thus, the user can set as needed whether to execute the quantization processing on the performed song.

Note that, the present disclosure is not limited to the above embodiments, and various types of modifications are possible.

Moreover, although the electronic musical instrument 100 is cited as an example of the equipment that includes the controller 101 in the aforementioned embodiment, the equipment may be an electronic apparatus such as a portable phone, a personal computer (PC), a personal digital assistant (PDA), or the like.

Moreover, in the aforementioned embodiment, an example is described in which the CPU of the controller 101 performs control operations. However, the control operations are not limited to software control by the CPU. Part or all of the control operations may be performed by the use of a hardware configuration such as dedicated logic circuitry or the like.

Moreover, in the aforementioned description, an example is cited in which the ROM 103 formed from non-volatile memory such as flash memory or the like is used as a computer-readable medium that stores the programs for the sound recording processing of the present disclosure. However, the computer-readable medium is not limited to this example, and a hard disc drive (HDD), a compact disc read only memory (CD-ROM), a digital versatile disc (DVD), or the like portable type storage medium may be used. Moreover, a carrier wave may be used in the present disclosure as the medium for providing, via a communication line, the data of the program according to the present disclosure.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic musical instrument comprising:

performance operational elements including a first operational element and a second operational element;

a memory; and at least one processor configured to:

reproduce song data, in response to a user operation of the first operational element during reproduction of the song data, (i) receive first performance information including event information indicating an event other than a note event and event timing information indicating a timing of the user operation of the first operational element, and (ii) store, in a first region of the memory, the first performance information, in response to a user operation of the second operational element during reproduction of the song data, (i) receive second performance information including note event information indicating a note event and note event timing information indicating a timing of the user operation of the second operational element, (ii) change the note event timing information into changed note event timing information indicating a timing among a plurality of timings determined in accordance with a set phonetic value, and (iii) store, in a second region of the memory, the second performance information including the changed note event timing information indicating the timing among the plurality of timings, and start merger of the song data, the first performance information stored in the first region, and the second performance information including the changed note event timing information stored in the second region when no song data is reproduced after completion of the reproduction of the song data.

2. The electronic musical instrument according to claim 1, wherein the at least one processor is configured to:

reproduce the song data, which is stored in a third region of the memory, and during reproduction of the song data, copy the song data stored in the third region to the first region.

3. The electronic musical instrument according to claim 1, wherein the at least one processor is configured to:

determine whether quantization is set to be effective, when a determination is made that the quantization is set to be effective, in response to the user operation of the second operational element during reproduction of the song data, store, in the second region, the second performance information that includes (i) the note event information indicating the note event and (ii) the changed note event timing information, and when a determination is made that the quantization is not set to be effective, in response to the user operation of the second operational element during reproduction of the song data, store, in the first region, the second performance information including (i) the note event information indicating the note event and (ii) the note event timing information indicating the timing of the user operation of the second operational element, the note event timing information being unchanged note event timing information not subject to the change.

4. The electronic musical instrument according to claim 1, wherein the at least one processor is configured to:

acquire a tick count of the set phonetic value and a value of a tick counter, determine, based on the acquired tick count of the phonetic value and the acquired value of the tick counter, a timing from among a plurality of timings determined in accordance with the phonetic value, and change the note event timing information to match the determined timing.

5. The electronic musical instrument according to claim 1, wherein the at least one processor is configured to:

set quantization to be effective or non-effective, and in response to completion of a performance, store, together with the song data for which reproduction is completed, one of (i) quantized second performance information stored in the second region and (ii) nonquantized first performance information stored in the first region, in accordance with whether the quantization is set to be effective or non-effective.

6. The electronic musical instrument according to claim 1, wherein the at least one processor is configured to:

determine that a performance is completed, in at least one of (i) a case where the at least one processor detects an operation that causes stoppage of sound recording of the performance by an operation of one of the performance operational elements and (ii) a case where the at least one processor determines that sound recording of the performance cannot be continued, and when a determination is made that the performance is completed, store the first performance information and the second performance information together with the song data in response to the completion of the performance.

7. A method for an electronic musical instrument, the electronic musical instrument including (i) performance operational elements including a first operational element and a second operational element, (ii) a memory, and (iii) at least one processor, and the method causing the electronic musical instrument to execute processing comprising:

causing the at least one processor to reproduce song data, in response to a user operation of the first operational element during reproduction of the song data, (i) receive first performance information including event information indicating an event other than a note event and event timing information indicating a timing of the user operation of the first operational element, and (ii) store, in a first region of the memory, the first performance information, in response to a user operation of the second operational element during reproduction of the song data, (i) receive second performance information including note event information indicating a note event and note event timing information indicating a timing of the user operation of the second operational element, (ii) change the note event timing information into changed note event timing information indicating a timing among a plurality of timings determined in accordance with a set phonetic value, and (iii) store, in a second region of the memory, the second performance information including the changed note event timing information indicating the timing among the plurality of timings, and start merger of the song data, the first performance information stored in the first region, and the second performance information including the changed note event timing information stored in the second region when no song data is reproduced after completion of the reproduction of the song data.

8. A non-transitory computer-readable storage medium storing a program for an electronic musical instrument, the electronic musical instrument including (i) performance operational elements including a first operational element and a second operational element, (ii) a memory, and (iii) at least one processor, and the program being executable by the electronic musical instrument to control the electronic musical instrument to execute processing comprising:

causing the at least one processor to reproduce song data, in response to a user operation of the first operational element during reproduction of the song data, (i) receive first performance information including event information indicating an event other than a note event and event timing information indicating a timing of the user operation of the first operational element, and (ii) store, in a first region of the memory, the first performance information, in response to a user operation of the second operational element during reproduction of the song data, (i) receive second performance information including note event information indicating a note event and note event timing information indicating a timing of the user operation of the second operational element, (ii) change the note event timing information into changed note event timing information indicating a timing among a plurality of timings determined in accordance with a set phonetic value, and (iii) store, in a second region of the memory, the second performance information including the changed note event timing information indicating the timing among the plurality of timings, and start merger of the song data, the first performance information stored in the first region, and the second performance information including the changed note event timing information stored in the second region when no song data is reproduced after completion of the reproduction of the song data.

* * * * *